US006712589B2

(12) United States Patent
Mori et al.

(10) Patent No.: US 6,712,589 B2
(45) Date of Patent: Mar. 30, 2004

(54) SCROLL COMPRESSORS

(75) Inventors: Tatsushi Mori, Kariya (JP); Masao Iguchi, Kariya (JP); Masahiro Kawaguchi, Kariya (JP); Yasuharu Odachi, Kariya (JP); Hirohito Hayashi, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/123,602

(22) Filed: Apr. 15, 2002

(65) Prior Publication Data

US 2002/0150485 A1 Oct. 17, 2002

(30) Foreign Application Priority Data

Apr. 17, 2001 (JP) ..... 2001-118705

(51) Int. Cl.[7] ..... F04B 17/00

(52) U.S. Cl. ..... 417/410.5; 418/55.3; 418/55.5; 418/57; 418/188

(58) Field of Search ..... 418/55.3, 55.5, 418/57, 188; 417/410.5

(56) References Cited

U.S. PATENT DOCUMENTS 4,753,582 A * 6/1988 Morishita et al. ..... 418/55.5
4,927,339 A * 5/1990 Riffe et al. ..... 418/55.3
5,090,876 A * 2/1992 Hashizume et al. ..... 417/410.5
5,295,808 A * 3/1994 Machida et al. ..... 417/410.5

FOREIGN PATENT DOCUMENTS

| | | | | |
|---|---|---|---|---|
| JP | 61-190183 | | 8/1986 | |
| JP | 62-191685 | | 8/1987 | |
| JP | 63263286 | A * | 10/1988 | ..... F04C/18/02 |
| JP | 02-125985 | | 5/1990 | |
| JP | 04066791 | A * | 3/1992 | ..... F04C/18/02 |
| JP | 04-166686 | | 6/1992 | |
| JP | 05018203 | A * | 1/1993 | ..... F01C/1/02 |
| JP | 05118324 | A * | 5/1993 | ..... F16C/19/12 |
| JP | 07-229480 | | 8/1995 | |

* cited by examiner

*Primary Examiner*—Thomas Denion
*Assistant Examiner*—Theresa Trieu
(74) *Attorney, Agent, or Firm*—Woodcock Washburn LLP

(57) ABSTRACT

Scroll compressors (1) may include a housing (2, 3) having an inlet port (3*a*) and an outlet port (3*b*). A drive scroll (10) may be rotatably disposed within the housing and may have a rotational axis. A driven scroll (20) may be rotatably disposed within the housing and may have a rotational axis. The driven scroll rotational axis preferably is offset to the drive scroll rotational axis. Further, at least one compression chamber (30) is preferably defined between the drive scroll and the driven scroll. A first bearing (14) may rotatably support the drive scroll in a cantilever manner and a second bearing (24, 115) may rotatably support the driven scroll in a cantilever manner. A transmission (31, 131, 231 and 331) or other device may be provided to rotate the drive scroll in synchronism with the driven scroll.

20 Claims, 8 Drawing Sheets

SCROLL COMPRESSORS

BACKGROUND OF THE INVENTION

1. Field of the Invention

The present invention relates to scroll compressors, and in particular to scroll compressors known as "double rotational compressors," in which a drive scroll rotates in synchronism with a driven scroll about respective rotational axes that are offset to each other.

2. Description of Related Art

Japanese Laid-open Patent Publication No. 7-229480 discloses a double rotational scroll compressor, in which a drive scroll and a driven scroll oppose each other and define a compression chamber therebetween. The drive scroll is secured to a rotor of an electric motor, and the rotor and the drive scroll are rotatably and coaxially supported within a housing. The driven scroll is rotatably supported by an eccentric mechanism that is mounted on a shaft and the shaft extends though the rotor. An Oldham's coupling serves to transmit the rotation of the rotor or the drive scroll to the driven scroll.

In such a scroll compressor, the rotor and the drive scroll secured to the rotor oppose each other and the driven scroll is interposed therebetween. Further, respective support shafts must support the rotor and the drive scroll. Therefore, the drive scroll is actually supported by support shafts disposed on both sides. In other words, the support shafts mounted within the housing must rotatably support the rotor of the electric motor. As a result, the length of the compressor along the axial direction of the rotor is relatively long. In addition, because the driven scroll is mounted on the support shaft (which supports the rotor) by means of the eccentric mechanism, the number of parts and the manufacturing costs of the compressor are relatively high.

SUMMARY OF THE INVENTION

Therefore, one object of the present teachings is to provide improved scroll compressors that preferably are more compact than known scroll compressors. Such scroll compressors may, e.g., find advantageous application in vehicle air conditioning systems.

In one aspect of the present teachings, scroll compressors are taught that have a drive scroll opposing a driven scroll. One or more compression chambers may be defined between the drive scroll and the driven scroll. One or both of the drive scroll and the driven scroll may be supported in a cantilever manner. Therefore, it is possible to eliminate a rotor support mechanism (a shaft and a bearing) as compared to known scroll compressors. Further, the length of the compressor along the axial direction of the scrolls can be reduced as compared to known scroll compressors. Therefore, scroll compressors according to the present teachings may be relatively compact in size. In addition, it is possible to eliminate some parts of the eccentric mechanism that are required in known scroll compressors, thereby reducing manufacturing costs.

In another aspect of the present teachings, a plane bearing or a needle bearing may movably support at least one of the drive scroll or the driven scroll along the axial direction. In addition, a refrigerant (cooling medium) may be compressed within the compression chamber and then may be discharged to the side of the drive scroll or the driven scroll that is movably supported along the axial direction. Therefore, the pressurized or compressed refrigerant may apply a force to the rear side of one of the drive scroll or the driven scroll. The amount of force applied to the rear side of the drive scroll or the driven scroll can be selectively determined by adjusting the size of a discharge chamber that may be defined within the drive scroll or the driven scroll. That is, the area of the rear side of the corresponding scroll, to which area the discharge pressure is applied, may be selectively modified in order to adjust the amount of force applied by the pressurized refrigerant. Therefore, the contacting pressure between the drive scroll and the driven scroll can be appropriately determined.

In another aspect of the present teachings, a transmission or other means for rotating the drive scroll in synchronism with the driven scroll may be provided. For example, the transmission may include a first torque transmission member disposed on the drive scroll and a second torque transmission member disposed on the driven scroll. The first torque transmission member may slidably contact the second torque transmission member, so that the rotation of the drive scroll is transmitted to the driven scroll. Therefore, the driven scroll can synchronously rotate with the drive scroll and the rotational axis of the driven scroll is preferably offset to the rotational axis of the drive scroll.

Preferably, the first transmission member can rotate relative to and around the second torque transmission member. Further, the radius of rotation of the first transmission member may be equal to the distance between the rotational axes of the drive scroll and the driven scroll. Therefore, rotational torque may be smoothly transmitted.

In another aspect of the present teachings, the first transmission member may comprise one of a pin or a ring and the second transmission member may comprise the other of a pin or a ring. In that case, the pin can slidably rotate along the inner circumferential surface of the ring. In another aspect, the first transmission member and the second transmission member may comprise respective pins and a ring may couple the respective pins. In that case, the pins can slidably rotate along the inner circumferential surface of the ring. In another aspect, the first and second torque transmission members may respectively comprise a first pin and a second pin. In that case, the first pin can slidably contact and rotate around the second pin. Further, a ring may be rotatably mounted on one of the first pin or the second pin, so that the first pin or the second pin can slidably rotate around the ring.

Additional objects, features and advantages of the present invention will be readily understood after reading the following detailed description together with the accompanying drawings and the claims.

DETAILED DESCRIPTION OF THE INVENTION

Figure 1:
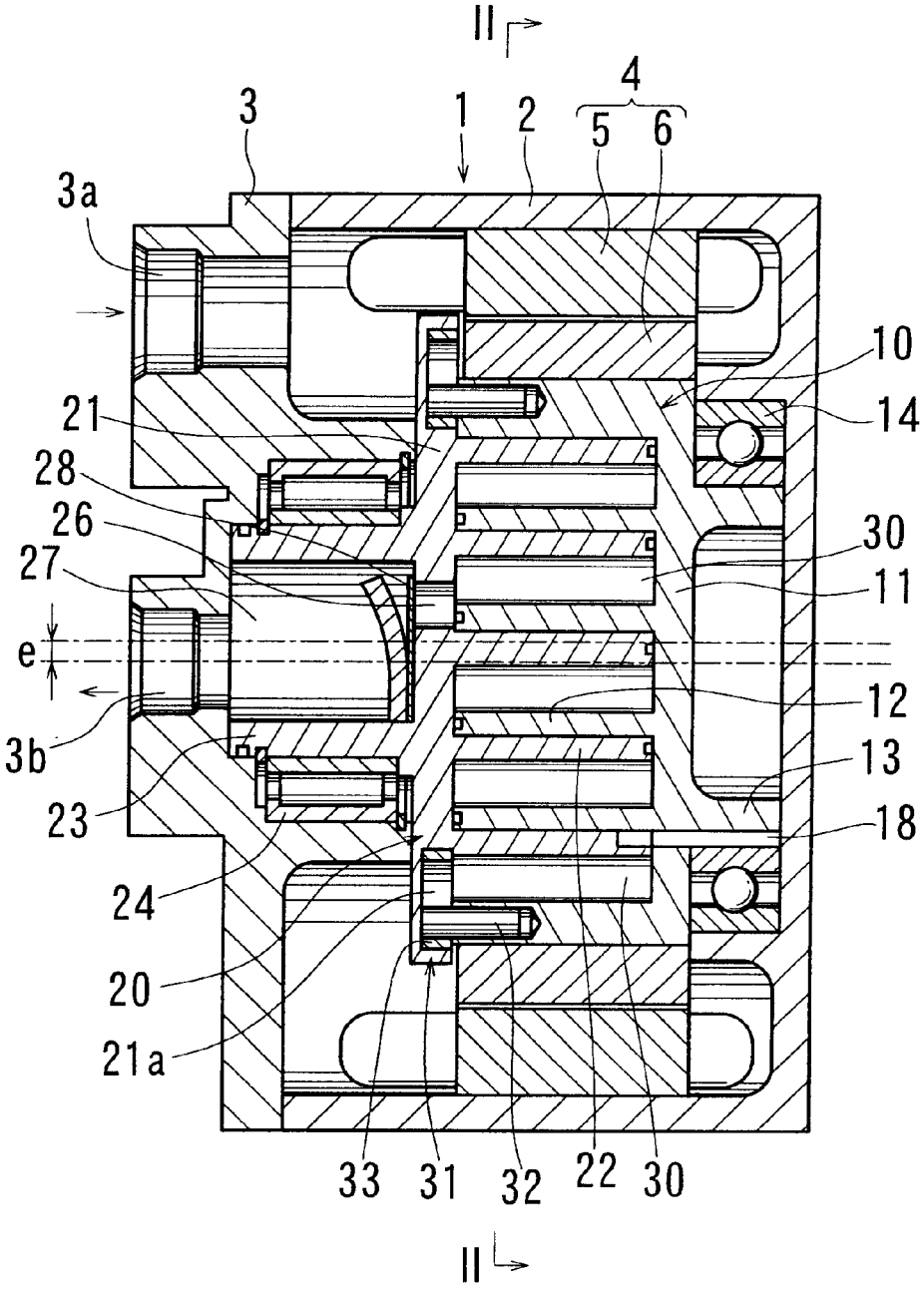
FIG. 1 is a vertical cross-sectional view of a first representative scroll compressor.

In one embodiment of the present teachings, scroll compressors may include a compressor housing having an inlet port and an outlet port. A drive scroll may be rotatably disposed within the compressor housing and may have a rotational axis. A driven scroll may be rotatably disposed within the compressor housing and may have a rotational axis. The driven scroll rotational axis is preferably offset to the drive scroll rotational axis. At least one compression chamber is preferably defined between the drive scroll and the driven scroll. Further, a first bearing may rotatably support the drive scroll in a cantilever manner and a second bearing may rotatably support the driven scroll in a cantilever manner. The first and second bearings are preferably disposed within the compressor housing.

In another embodiment of the present teachings, a transmission or other means may be provided for rotating the drive scroll in synchronism with the driven scroll. For example, the rotational axis of the drive scroll may be parallel, or substantially parallel, to the rotational axis of the driven scroll, but the respective rotational axes may be offset to each other in a direction perpendicular to the rotational axes. The transmission or rotating means may include a transmission mechanism that causes the driven scroll to revolve or orbit with respect to the drive scroll.

In another embodiment of the present teachings, the transmission mechanism may include at least two first members coupled to at least one of the drive scroll or the driven scroll and at least two second members coupled to at least one of the drive scroll or the driven scroll. The respective first members may slidably contact the respective second members. In that case, rotational torque may be transmitted from the drive scroll to the driven scroll as the drive scroll rotates.

In another embodiment, the transmission mechanism may include a first torque transmission member disposed on the drive scroll and a second torque transmission member disposed on the driven scroll. The first torque transmission member may slidably contact the second torque transmission member so that rotation of the drive scroll is transmitted to the driven scroll. Optionally, the first transmission member can rotate relative to and around the second torque transmission member. Further, the radius of rotation of the first transmission member may be equal to the distance between the rotational axes of the drive scroll and the driven scroll.

In another embodiment, the first transmission member may include a pin and the second transmission member may include a ring. Preferably, the pin can slidably rotate along the inner circumferential surface of the ring.

In another embodiment, the first transmission member and the second transmission member each include pins and a ring may couple the respective pins. In this case, the pins can slidably rotate along the inner circumferential surface of the ring.

In another embodiment, the first and second torque transmission members may respectively include a first pin and a second pin. In this case, the second pin can slidably rotate about the first pin.

In another embodiment, a ring may be rotatably mounted on one of the first pin or the second pin. In this case, the first pin or the second pin can slidably rotate around the ring.

In another embodiment, the drive scroll may include a first support portion rotatably supported by the first bearing and the driven scroll may include a second support portion rotatably supported by the second bearing. The first and second support portions may be respectively disposed on opposite sides of the compression chambers along the axial direction of the first and second support portions. Optionally, the first support portion may have a hollow cylindrical cross-section and the first support portion may be fitted within the first bearing. Further, the second support portion may have a hollow cylindrical cross-section and the second support portion may be fitted within the second bearing.

In another embodiment, an electric motor may rotatably drive the drive scroll. The electric motor may include a rotor secured to the drive scroll and a stator secured to an inner wall of the housing. Optionally, the stator, the rotor and the drive scroll may be concentrically disposed. For example, the rotor may be disposed within the stator and the drive scroll may be disposed within and secured to the rotor.

In another embodiment, means may be provided for permitting at least one of the drive and driven scrolls to move along the axial direction. For example, the first and/or second bearing may be designed to allow one of the drive scroll or the driven scroll to move along the axial direction. Optionally, the driven scroll can move along the axial direction and the drive scroll is fixed in position along the axial direction.

In addition, means may be provided for biasing the drive scroll towards the driven scroll. For example, the biasing means may include a discharge chamber defined within the housing. For example, the discharge chamber may be defined within the drive scroll or the driven scroll. The discharge chamber may communicate with the outlet port and may be disposed adjacent to the driven scroll. In one embodiment, refrigerant may be drawn into the at least one compression chamber via the inlet port and then compressed within the at least one compression chamber. Thereafter, the compressed refrigerant may be discharged into the discharge chamber and the compressed refrigerant may apply a force against the driven scroll or the drive scroll that urges the driven scroll toward the drive scroll or vice versa. Optionally, the discharge chamber may be defined within a portion of the driven scroll that is fitted with the second bearing.

Various methods also are taught for compressing a refrigerant using the scroll compressors, which are described above and below in further detail. Generally speaking, such methods may include drawing refrigerant into the compression chambers and rotating the drive scroll in synchronism with the driven scroll in order to generate pressurized refrigerant. In one optional method, the position of the first scroll may be fixed along the axial direction. Further, the second scroll may be biased toward the first scroll along the axial direction using the pressurized refrigerant. As a result, the second scroll may contact the first scroll and the position of the second scroll may become fixed along the axial direction.

Each of the additional features and method steps disclosed above and below may be utilized separately or in conjunction with other features and method steps to provide improved scroll compressors and methods for designing and using such scroll compressors. Representative examples of the present invention, which examples utilize many of these additional features and method steps in conjunction, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe some representative examples of the invention, which detailed description will now be given with reference to the accompanying drawings.

Figure 2:
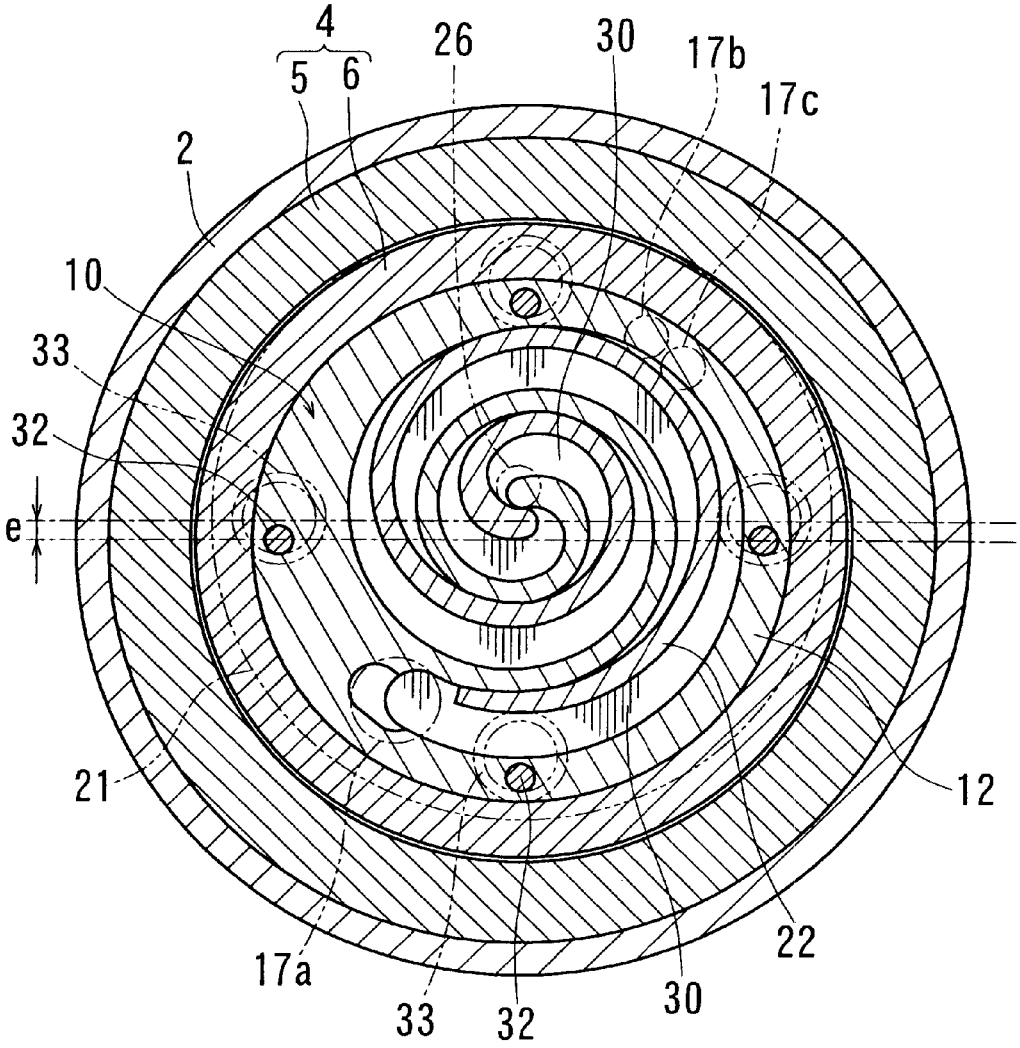
FIG. 2 is a sectional view taken along line II—II shown in FIG. 1.

A first representative embodiment will now be described with reference to FIGS. 1 to 4. As shown in FIGS. 1 and 2, a first representative scroll compressor 1 may include a front cover 3 that is attached to a main housing 2 in order to close a front opening defined within the main housing 2. Thus, the compressor housing may comprise the main housing 2 and the front cover 3, although other housing arrangements are contemplated by the present teachings. Therefore, a substantially enclosed space is defined within the compressor housing. An electric motor 4 and a scroll compression mechanism, which may include a drive scroll 10 and a driven scroll 20, may be disposed within the compressor housing.

The electric motor 4 may include an annular-shaped rotor 6 positioned or disposed within an annular-shaped stator 5. The drive scroll 10 may be fixedly fitted within the rotor 6. In this case, the drive scroll 10 will rotate with the rotor 6. The driven scroll 20 may be disposed so as to oppose to the drive scroll 10. The drive scroll 10 may include a scroll wall 12 that is formed on and extends from one side of a circular disk-like base plate 11. Similarly, the driven scroll 20 may include a scroll wall 22 that is formed on and extends from one side of a circular disk-like base plate 21. The drive scroll 10 and the driven scroll 20 are preferably arranged such that the scroll walls 12 and 22 engage with each other. For example, the scroll walls 12 and 22 may contact each other at a plurality of positions so as to define substantially crescent-shaped compression chambers (closed chambers) 30 between the scroll walls 12 and 22.

Referring to FIG. 1, a support portion or a protruding portion 13 may extend from the base plate 11 of the drive scroll 10 on the side opposite to the compression chambers 30. A ball bearing 14 may be disposed within the main housing 2 and may rotatably support the protruding portion 13. Similarly, a support portion or a protruding portion 23 may extend from the base plate 21 of the driven scroll 20 on the side opposite to the compression chambers 30. A needle bearing 24 may be disposed within the front cover 3 and may rotatably support the protruding portion 23. Further, the needle bearing 24 may include an inner race that is fitted onto the protruding portion 23. The rotational axis of the driven scroll 20 (i.e., the rotational axis of the protruding portion 23) may extend in parallel to the rotational axis of the drive scroll 10 (i.e., the rotational axis of the protruding portion 13) but may be offset to the rotational axis of the drive scroll 10 in a direction perpendicular to the rotational axis by a distance "e" as shown in FIGS. 1 and 2.

Thus, the drive scroll 10 and the driven scroll 20 are rotatably supported respectively by the main housing 2 and the front cover 3 in a cantilever manner from the sides that are opposite to the compression chambers 30. In addition, the respective rotational axes of the drive scroll 10 and the driven scroll 20 are offset to each other.

Herein, the term "cantilever" is intended to encompass support structures that include a member that is supported at only one end. Thus, cantilever support structures differ from support structures in which a drive scroll or a driven scroll is supported at both sides (i.e., both sides of a drive scroll or a driven scroll are supported). For example, in the first representative embodiment, the drive scroll 20 is supported only from the side that is opposite to the compression chambers 30. Consequently, such a support structure may be referred to as a cantilever support structure.

Figure 3:
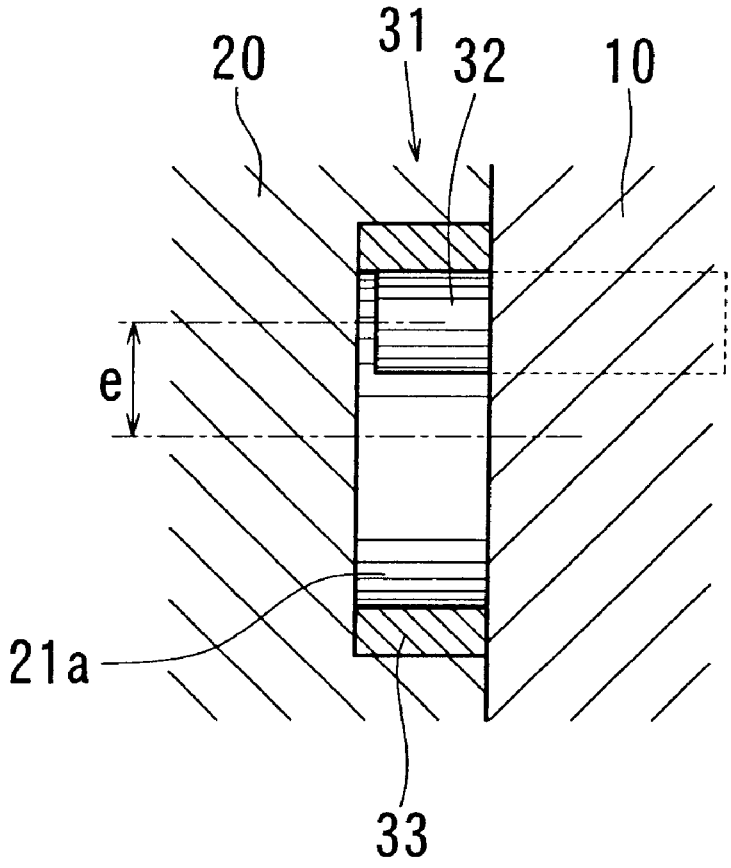
FIG. 3 is a cross-sectional view of a first representative transmission mechanism.
Figure 4:
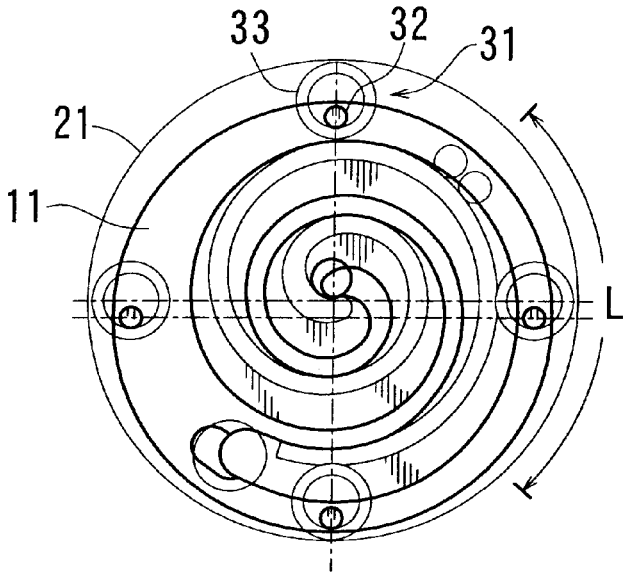
FIGS. 4(A) to 4(F) are views illustrating the compressor disposed in various angular positions during compressor operation.
Figure 4:
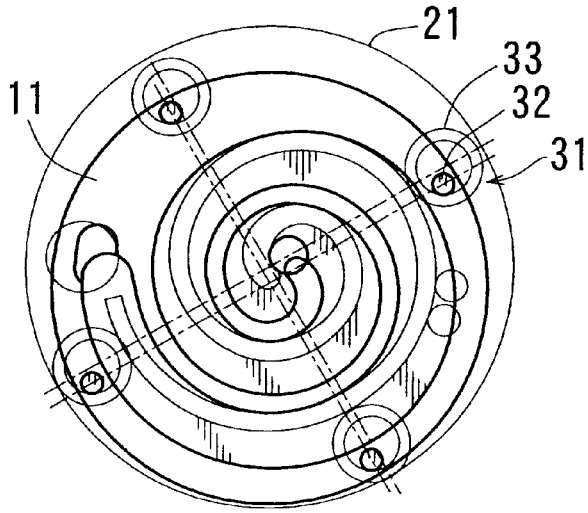
Figure 4:
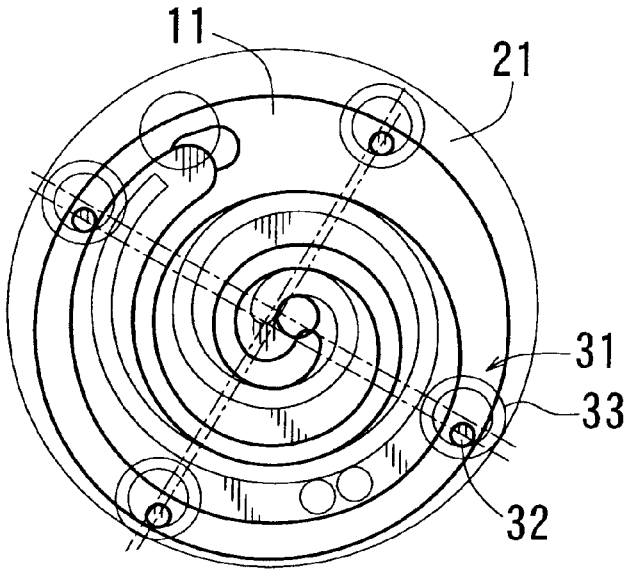
Figure 4:
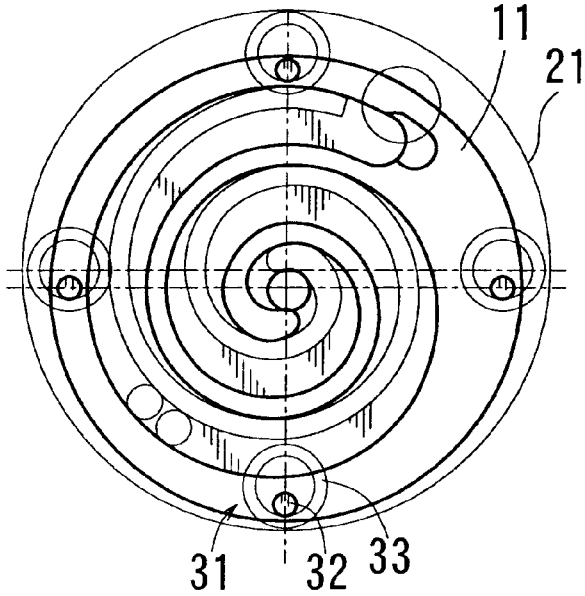
Figure 4:
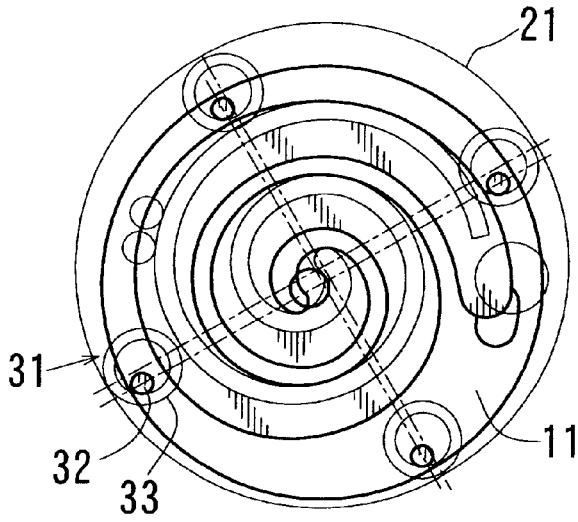
Figure 4:
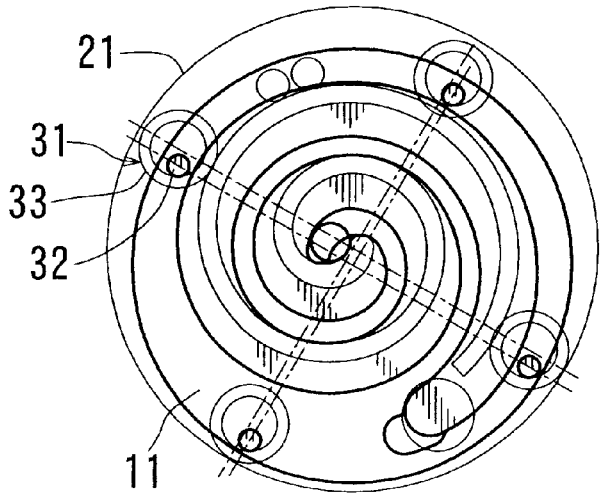

Still referring to FIG. 1, a transmission or transmission mechanism 31 may be disposed between the drive scroll 10 and the driven scroll 20. The transmission mechanism 31 may serve to transmit the rotation of the drive scroll 10 to the driven scroll 20, so that the driven scroll 20 will rotate in synchronism with the drive scroll 10. As shown in FIGS. 2 and 3, the transmission mechanism 31 may include a plurality of pins 32 and a plurality of rings 33 (e.g., four pins 32 and rings 33 are shown in the first representative embodiment). The pins 32 may be attached to the outer peripheral portion of the scroll wall 12 of the drive scroll 10 and may extend forwardly from the front surface of the scroll wall 12 along the axial direction of the drive scroll 10. The pins 32 may be spaced from each other around the circumference of the scroll wall 12 at suitable intervals. The rings 33 may be attached to the scroll plate 21 of the driven scroll 20 at positions corresponding to the pins 32. Therefore, the pins 32 may contact the inner circumferential surfaces of the respective rings 33. Preferably, the rings 33 may be fitted into respective circular recesses 21*a* that are defined within the scroll plate 21. If rings 33 are incorporated into the design, the outer diameter of the scroll plate 21 preferably may be greater than the outer diameter of the scroll wall 12 of the drive scroll 10.

Accordingly, as the drive scroll 10 rotates with the rotor 6, the pins 32 may slide along the inner circumferential surfaces of the respective rings 33. Therefore, the rings 33 will be urged to rotate about their central axes. As a result, the rotational torque of the drive scroll 10 can be transmitted to the driven scroll 20. As shown in FIG. 3, the distance between the central axis of the ring 33 and the central axis of the pin 32 during this transmission may be, e.g., equal to the distance "e" between the rotational axis of the drive scroll 10 and the rotational axis of the driven scroll 20.

FIGS. 4(A) to 4(F) serially depict views of the first representative embodiment as torque is transmitted via the pins 32 and the rings 33. These figures show each rotational angle of 60° during one full or complete rotation (i.e., 360°) of the drive scroll 10. As the drive scroll 10 rotates with the rotor 6, the pins 32 slidably contact the inner circumferential surfaces of the respective rings 33 in order to transmit rotational torque from the drive scroll 10 to the driven scroll 20. For example, each of the pins 32 may transmit rotational torque to the respective ring 33 only when the pin 32 is positioned within an angular range L, as indicated in FIG. 4(A). Although the driven scroll 20 rotates in synchronism with the drive scroll 10, the rotational axis of the driven scroll 20 is offset to the rotational axis of the drive scroll 10. Therefore, the driven scroll 20 revolves (orbits) relative to the drive scroll 10.

As a result, refrigerant is drawn into the main housing 2 via an inlet port 3*a* defined in the front cover 3, as shown in FIG. 1. As shown in FIG. 2, the refrigerant is then closed into the compression chamber 30 via suction ports 17*a*, 17*b* and 17*c*, which ports 17*a*, 17*b* and 17*c* are defined within the base plate 21 of the driven scroll 20 and are located at an interval of an angle of 180° from each other. As the driven scroll 20 revolves (orbits) with respect to the drive scroll 10, each compression chambers 30 will move in a direction from the outer periphery to the center of the scroll walls 12 and 22 of the drive and driven scrolls 10 and 20. The volume of each compression chamber 30 will decrease as the compression chambers 30 move toward the inner circumferential ends of the scroll walls 12 and 22.

As shown in FIG. 1, a sub suction port 18 may be defined between the protruding portion 13 and the bearing 14 and may extend through the base plate 11 of the drive scroll 10. Therefore, the refrigerant also may be drawn into the compression chambers 30 via the motor 4 and the bearing 14.

Still referring to FIG. 1, a discharge port 26 may be defined within the central portion of the base plate 21 of the driven scroll 20 and may communicate with the innermost compression chamber 30. A discharge chamber 27 may be defined within the second protruding portion 23 on the front side of the base plate 21. A discharge valve 28 may be disposed within the discharge chamber 27 and may serve to open and close the discharge port 26. For example, the discharge valve 28 may be a reed valve. However, other types of valves may be utilized as the discharge valve. The front cover 3 may cover or enclose the front side of the discharge chamber 27 and may include an outlet port 3*b* that communicates with the discharge chamber 27. A refrigerant discharge line to an outside circuit (not shown), such as an air conditioning circuit, may be connected to the outlet port 3*b*.

According to the above-described first representative scroll compressor, both the drive scroll 10 and the driven scroll 20 are supported in a cantilever manner on one side and the other side opposite to the compression chambers 30 along the axial direction, respectively. In particular, the rotor 6 of the electric motor 4 may be secured to the drive scroll 10 so as to rotate together and the drive scroll 10 may be rotatably supported in a cantilever manner. Therefore, the support structure of the rotor 6 can be simplified as compared to known scroll compressors. In fact, the length of the rotor 6 can be shortened, as compared to known scroll compressors, by the length of a shaft that is required to support the side of the rotor 6 that opposite to the protruding portion 13 in known scroll compressors. In addition, a bearing for rotatably supporting such a shaft on the opposite side may be eliminated, which bearing is required in known scroll compressors.

Further, in known scroll compressors, an eccentric support mechanism must be mounted on a rotor shaft and in order to support the driven scroll. Therefore, in known scroll compressors, the axis of the driven scroll is offset to a drive scroll while both ends of the driven scroll must be supported. In the first representative embodiment, such an eccentric support mechanism may be eliminated.

Moreover, in the first representative embodiment, the refrigerant pressurized within the compression chambers 30 may be discharged to the side of the driven scroll 20 that is opposite to the compression chambers 30. On the other hand, the refrigerant that is returned from an external air conditioning circuit may be drawn in the main housing 2 via the inlet port 3*a*. Therefore, a relatively low-pressure region may be provided within the main housing 2. Consequently, the main housing 2 may be constructed using a relatively thin wall, thereby reducing the total weight of the compressor 1. Furthermore, because the temperature of the drawn (i.e., relatively low pressure) refrigerant is lower than the temperature of the discharged (i.e., relatively high pressure) refrigerant, the motor 4 can be effectively cooled by the drawn refrigerant and the motor bearings (e.g., bearing 14) can be effectively lubricated by lubricating oil circulated by the refrigerant.

Figure 5:
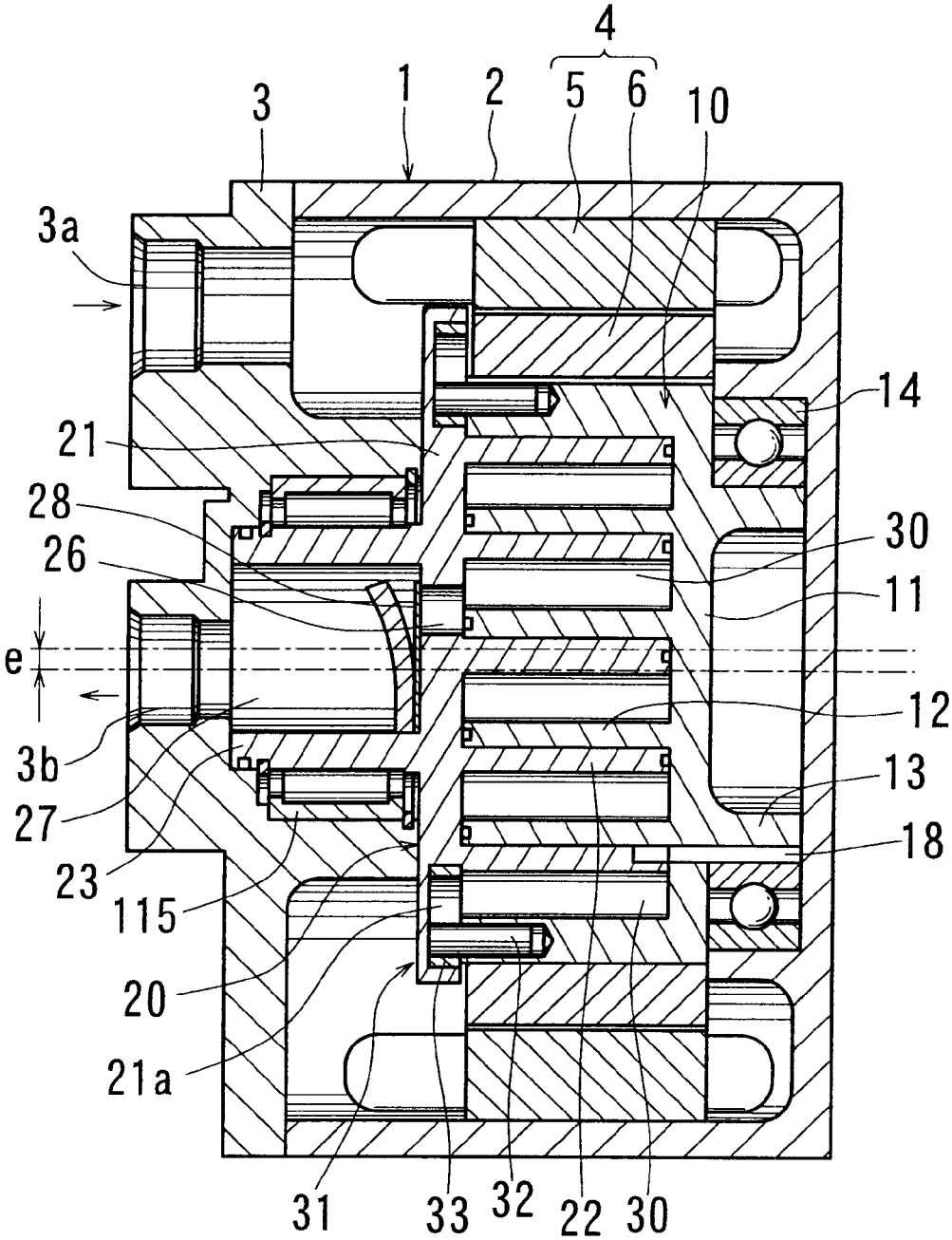
FIG. 5 is a cross-sectional view of second representative scroll compressor.

A second representative embodiment, which provides an alternative arrangement of the support structure of the driven scroll 20, will now be described with reference to FIG. 5. In the second representative embodiment, bearing 115 generally performs the function of the bearing 24 shown in the first representative embodiment. In addition, bearing 115 may movably support the driven scroll 20 such that the driven scroll 20 can move along the axial direction. The bearing 115 may be a needle bearing as shown in FIG. 5 or may be a plane bearing. In other respects, the construction of the second representative embodiment may be the same, or substantially the same, as the first representative embodiment.

In the second representative embodiment, the pressure of the discharged refrigerant is applied to the front side of the base plate 21 of the driven scroll 20. Therefore, during operation of the compressor 1, the driven scroll 20 will be pressed against the drive scroll 10. The amount of force applied by the discharged refrigerant, which presses the driven scroll 20 against the drive scroll 10, may be selectively determined by adjusting the size of the discharge chamber 27 or the front surface area of the base plate 21 of the driven scroll 20, against which the discharge pressure is applied. For example, the contacting force between the rear end of the scroll wall 22 of the driven scroll 21 and the base plate 11 of the drive scroll 10 or the contacting force between the front end of the scroll wall 12 of the drive scroll 10 and the base plate 21 of the driven scroll 20 may be appropriately determined. In addition, the relative position of the drive scroll 10 and the driven scroll 20 can be easily set. Furthermore, the cost of the bearing 115 may be reduced.

Although only the driven scroll 20 of the second representative embodiment can move along the axial direction, both the drive scroll 10 and the driven scroll 20 may move along the axial direction in further modifications of the present teachings. In such case, the main housing 2 and the front cover 3 may serve as stoppers and the corresponding end portions of the drive scroll 10 and the driven scroll 20 may contact the respective stoppers. Thus, the compressor housing 2, 3 can be utilized to limit the movable range of the drive scroll 10 and the driven scroll 20.

Figure 6:
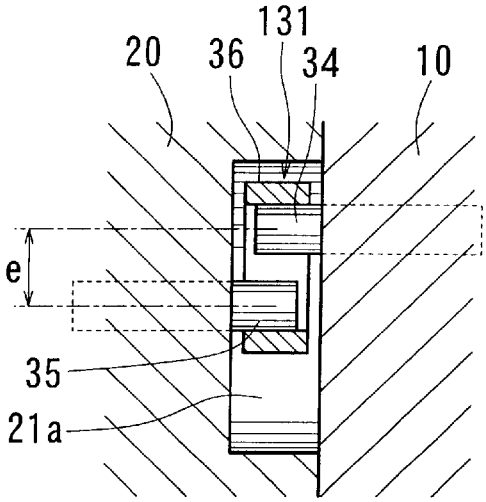
FIG. 6 is a cross-sectional view of a second representative transmission mechanism.
Figure 7:
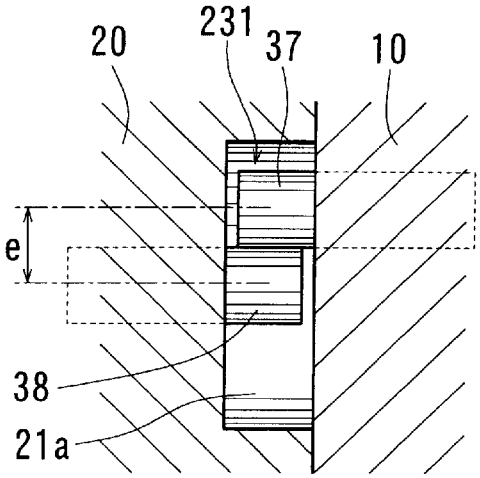
FIG. 7 is a cross-sectional view of a third representative transmission mechanism.
Figure 8:
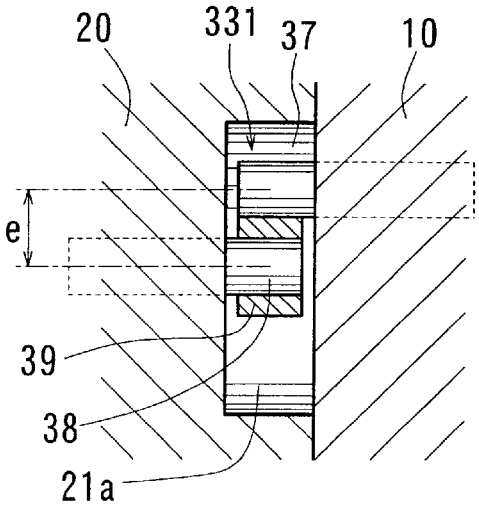
FIG. 8 is a cross-sectional view of a fourth representative transmission mechanism.

FIGS. 6 to 8 show additional modifications of the transmission mechanism 31, which causes the driven scroll 20 to rotate in synchronism with the drive scroll 10. Each of these modifications may be suitably utilized with the above-described first and second representative embodiments.

A transmission mechanism 131 of the embodiment shown in FIG. 6 may be configured as a pin-ring-pin system and may include cylindrical pins 34, 35 and a free ring 36. The pins 34 and 35 may be respectively mounted on the drive scroll 10 and the driven scroll 20. The pins 34, 35 and the free ring 36 may be arranged such that the pins 34 and 35 may slidably contact the inner circumferential surface of the free ring 36. Further, the central axes of the pins 34, 35 and the free ring 36 may be aligned along the same line. The free ring 36 may be disposed within a circumferential recess 21*a* formed in the driven scroll 20. Therefore, the free ring 36 can rotate about the pin 35 within the recess 21*a*.

A transmission mechanism 231 of the embodiment shown in FIG. 7 may be configured as a pin-pin system and may include pins 37 and 38. This arrangement may provide a simple transmission mechanism for synchronously driving the driven scroll with the drive scroll. The pins 37 and 38 may be fixedly mounted or rotatably mounted on the drive scroll 10 and the driven scroll 20, respectively. According to this arrangement, the pin 37 rotates around the pin 38 and the pin 37 may slidably contact the pin 38. Thus, rotational torque can be transmitted from the drive scroll 10 to the driven scroll 20.

A transmission mechanism 331 of the embodiment shown in FIG. 8 is similar to the transmission mechanism 231 shown in FIG. 7. However, the transmission mechanism 331 differs from the transmission mechanism 231 in that a ring 39 is rotatably mounted on the pin 38. Therefore, the pin 37 slidably contacts the ring 39 around the pin 38. This arrangement may reduce friction during sliding contact between the pins 37 and 38 and may reduce the wear of the pins 37 and 38. Although not shown in the drawings, a ring also may be rotatably mounted on the pin 37.

Thus, each of the transmission mechanisms 31, 131, 231 and 331 may have a relatively simple construction while permitting the driven scroll 20 to smoothly rotate in synchronism with the drive scroll 10.

In one additional modification of the present teachings, although the discharge port 26 is defined within the driven scroll 20 in the above representative embodiments, the discharge port 26 alternatively may be defined within the drive scroll 10.

What is claimed is:

1. A scroll compressor comprising:

a compressor housing having an inlet port and an outlet port, a drive scroll rotatably disposed within the compressor housing and having a rotational axis, a driven scroll rotatably disposed within the compressor housing and having a rotational axis, wherein the driven scroll rotational axis is offset to the drive scroll rotational axis and at least one compression chamber is defined between the drive scroll and the driven scroll, a first bearing rotatably supporting the drive scroll in a cantilever manner, a second bearing rotatably supporting the driven scroll in a cantilever manner, means for permitting the driven scroll to move along the axial direction, and means for biasing the driven scroll towards the drive scroll, wherein the biasing means comprises a discharge chamber defined within the compressor housing, the discharge chamber communicating with the outlet port and being disposed adjacent to the driven scroll, wherein refrigerant drawn into the at least one compression chamber via the inlet port and compressed within the at least one compression chamber is discharged into the discharge chamber, and the compressed refrigerant applies a force against the driven scroll that urges the driven scroll toward the drive scroll.

2. A scroll compressor as in claim 1, further comprising means for rotating the drive scroll in synchronism with the driven scroll.

3. A scroll compressor as in claim 2, wherein the rotational axis of the drive scroll is parallel, or substantially parallel, to the rotational axis of the driven scroll, but the respective rotational axes are offset to each other in a direction perpendicular to the rotational axes, and the rotating means comprises a transmission mechanism that causes the driven scroll to revolve or orbit with respect to the drive scroll.

4. A scroll compressor as in claim 3, wherein the transmission mechanism comprises at least two first members coupled to at least one of the drive scroll or the driven scroll and at least two second members coupled to at least one of the drive scroll or the driven scroll, wherein respective first members slidably contact respective second members, whereby rotational torque is transmitted from the drive scroll to the driven scroll as the drive scroll rotates.

5. A scroll compressor as in claim 1, wherein the drive scroll comprises a first support portion rotatably supported by the first bearing and the driven scroll comprises a second support portion rotatably supported by the second bearing, the first and second support portions being respectively disposed on opposite sides of the at least one compression chamber along the axial direction of the first and second support portions.

6. A scroll compressor as in claim 5, wherein the first support portion has a hollow cylindrical cross-section and the first support portion is fitted within the first bearing.

7. A scroll compressor as in claim 6, wherein the second support portion has a hollow cylindrical cross-section and the second support portion is fitted within the second bearing.

8. A scroll compressor as in claim 1, further comprising an electric motor rotatably driving the drive scroll.

9. A scroll compressor as in claim 8, wherein the electric motor comprises a rotor secured to the drive scroll and a stator secured to an inner wall of the compressor housing.

10. A scroll compressor as in claim 9, wherein the stator, the rotor and the drive scroll are concentrically disposed, such that the rotor is disposed within the stator and the drive scroll is disposed within and secured to the rotor.

11. A scroll compressor as in claim 1, wherein the drive scroll is fixed position along the axial direction.

12. A scroll compressor as in claim 1, wherein the discharge chamber is defined within a portion of a support portion of the driven scroll that is fitted with the second bearing.

13. A scroll compressor comprising:

a drive scroll having a rotational axis, a drive mechanism arranged and constructed to rotate the drive scroll, a driven scroll having a rotational axis offset to the rotational axis of the drive scroll, wherein the drive scroll opposes the driven scroll so as to define a compression chamber therebetween, and at least one of the drive scroll or the driven scroll is supported in a cantilever manner on a side opposite to the compression chamber, and a transmission arranged and constructed to rotate the driven scroll in synchronism with the drive scroll, wherein the transmission includes a first torque transmission member disposed on the drive scroll and a second torque transmission member disposed on the driven scroll, the first torque transmission member slidably contacting the second torque transmission member, whereby rotation of the drive scroll is transmitted to the driven scroll, and wherein the first torque transmission member is arranged and constructed to rotate relative to and around the second torque transmission member, the rotational axes of the drive scroll and the driven scroll are offset to each other, and the radius of rotation of the first torque transmission member is equal to the offset distance between the rotational axes of the drive scroll and the driven scroll.

14. A scroll compressor as in claim 13, wherein both the driven scroll and the drive scroll are supported in a cantilever manner.

15. A scroll compressor as in claim 13, further comprising a plane bearing or a needle bearing movably supporting at least one of the drive scroll or the driven scroll along an axial direction.

16. A scroll compressor as in claim 13, wherein the first torque transmission member comprises a pin, and the second torque transmission member comprises a ring, wherein the pin is arranged and constructed to slidably rotate along an inner circumferential surface of the ring.

17. A scroll compressor as in claim 13, wherein the first torque transmission member and the second torque transmission member each respectively comprise a pin and the transmission further includes a ring, wherein the pins are arranged and constructed to slidably rotate along an inner circumferential surface of the ring.

18. A scroll compressor as in claim 13, wherein the first and second torque transmission members respectively comprise a first pin and a second pin, wherein the first pin is arranged and constructed to slidably rotate around the second pin.

19. A scroll compressor as in claim 18, further comprising at least one ring rotatably mounted on one of the first pin or the second pin, wherein the first pin and/or the second pin can slidably rotate around an outer circumferential surface of the ring.

20. A scroll compressor as in claim 13, further comprising a bearing arranged and constructed to allow at least one of the drive and driven scrolls to move along the axial direction, and means for biasing the driven scroll towards the drive scroll.

* * * * *